US011468771B2

(12) United States Patent
Ma et al.

(10) Patent No.: US 11,468,771 B2
(45) Date of Patent: Oct. 11, 2022

(54) COLLABORATIVE CONTROLLING METHOD OF VARIABLE SPEED LIMIT AND RAMP METERING FOR EXPRESSWAYS BASED ON CRASH RISK

(71) Applicant: TONGJI UNIVERSITY, Shanghai (CN)

(72) Inventors: Wanjing Ma, Shanghai (CN); Ziliang He, Shanghai (CN); Ling Wang, Shanghai (CN); Chunhui Yu, Shanghai (CN)

(73) Assignee: TONGJI UNIVERSITY, Shanghai (CN)

( * ) Notice: Subject to any disclaimer, the term of this patent is extended or adjusted under 35 U.S.C. 154(b) by 0 days.

(21) Appl. No.: 17/468,673

(22) Filed: Sep. 8, 2021

(65) Prior Publication Data

US 2022/0076570 A1 Mar. 10, 2022

(30) Foreign Application Priority Data

Sep. 8, 2020 (CN) ..... 202010935327.3

(51) Int. Cl.
*G08G 1/07* (2006.01)
*G08G 1/08* (2006.01)

(52) U.S. Cl.
CPC ..... *G08G 1/075* (2013.01); *G08G 1/08* (2013.01)

(58) Field of Classification Search
CPC ..... G08G 1/075; G08G 1/08
See application file for complete search history.

(56) References Cited

U.S. PATENT DOCUMENTS

2008/0074246 A1* 3/2008 Isaji ..... B60W 30/18145 701/301

* cited by examiner

*Primary Examiner* — Mohamed Barakat
*Assistant Examiner* — Sharmin Akhter
(74) *Attorney, Agent, or Firm* — JCIP Global Inc.

(57) ABSTRACT

The invention relates to a variable speed limit (VSL), ramp metering (RM), and a collaborative method of variable speed limit and ramp metering (VSL-RM) on expressways based on crash risk, including the following steps: 1) calculating the crash risk index within each control step, activating the VSL-RM strategy when the crash risk index exceeds the threshold of the crash risk index, and 2) conduct a multiple-ramp metering strategy, determine the ramps to be controlled and the start-up time for RM, and calculate the integrated ramp regulation rate; 3) execute a variable speed limit strategy to obtain the displayed speed limit value for the segment downstream of the cluster and adjust the ramp regulation rate, mainline desired speed and mainline speed of the segment for the next time period accordingly.

10 Claims, 4 Drawing Sheets

COLLABORATIVE CONTROLLING METHOD OF VARIABLE SPEED LIMIT AND RAMP METERING FOR EXPRESSWAYS BASED ON CRASH RISK

CROSS-REFERENCE TO RELATED APPLICATION

This application claims the priority benefit of China application serial no. 202010935327.3, filed on Sep. 8, 2020. The entirety of the above-mentioned patent application is hereby incorporated by reference herein and made a part of this specification.

TECHNICAL FIELD

The invention relates to the field of Active Traffic Management (ATM) on expressways, in particular to a collaborative controlling method of variable speed limit and ramp metering for expressways based on crash risk.

BACKGROUND

One of the effective ways to improve the expressway safety is Active Traffic Management (ATM), which can manage road facilities dynamically according to current and predicted traffic conditions, such as ramp metering, variable speed limit, etc. For ATM strategies, variable speed limits and ramp metering are commonly used. The control object of variable speed limit is the speed limit value of the mainline of the expressway, while the object of the ramp metering is the incoming flow value of the upper ramp. Previous studies have shown that variable speed limits can significantly reduce speed differences between vehicles, smooth traffic flow, and have the potential to improve traffic safety and reduce the risk of crashes. Ramp metering can improve traffic safety by reducing the impact of traffic flow on the mainline during peak periods or in high-risk crash situations.

At present, many variable speed limit and ramp metering methods are mainly for the possibility of crashes occurring on a certain segment of the road or after the occurrence of a crash to implement control, and the current variable speed limit and ramp metering methods are more single point, single strategy. The implementation of control strategies at a single point may shift the risk of crashes from upstream to downstream, and single-policy control may not be able to better exploit the benefits of the strategy.

SUMMARY OF THE DISCLOSURE

The purpose of the invention is to provide a collaborative method of variable speed limit and ramp metering based on crash risk in order to overcome the defects existing in the existing technology.

The purpose of the present invention can be achieved by the following technical schemes:

A collaborative controlling method of variable speed limit and ramp metering for expressways based on crash risk, characterized by the following steps:

1) The crash risk index CI within each control step is calculated, and the collaborative controlling method of variable speed limit and ramp metering are activated when the crash risk index CI exceeds the threshold of the crash risk index.

2) A multiple-ramp metering strategy is executed, the ramps to be controlled and the start-up time for RM are determined, and calculate the integrated ramp regulation rate $h_i'(k)$ is calculated;

3) A variable speed limit strategy is executed to obtain the displayed speed limit value for the segment downstream of the cluster and adjust the ramp regulation rate, mainline desired speed and mainline speed of the segment for the next time period accordingly. The goal is to minimize the crash risk of the vehicle group in the following period, and the optimal combination of speed limit and ramp metering rate of the segments to be passed in the next period are obtained.

A collaborative approach of variable speed limit and ramp metering for expressways based on crash risk, as described in claim 1, is characterized by the fact that, in step 1), the crash risk indexes CI was calculated on the basis of the METANET traffic flow and its expression is:

$$CI=\Sigma_{r=1}^{R}\beta_r x_r$$

wherein $\beta_r$ is the coefficient of the $r^{th}$ variable, $x_r$ is the $r^{th}$ variable, and R is the total number of variables.

The variables and the corresponding meanings and coefficients are shown in the table below.

| Variable $x_r$ | Meaning | Variable coefficient $\beta_r$ |
|---|---|---|
| $Speed_{diff,\ 1\ min}$ | The speed difference of the vehicle group before 0-1 min | 0.292 |
| $Speed_{diff,\ 2\ min}$ | The speed difference of the vehicle group before 1-2 min | 0.125 |
| $Speed_{diff,\ 3\ min}$ | The speed difference of the vehicle group before 2-3 min | 0.191 |
| $Speed_{diff,\ 4\ min}$ | The speed difference of the vehicle group before 3-4 min | 0.107 |
| $Vol_{diff,\ 1\ min}$ | The traffic difference of the vehicle group before 0-1 min | 0.105 |
| $Vol_{diff,\ 2\ min}$ | The traffic difference of the vehicle group before 1-2 min | 0.054 |
| $Vol_{diff,\ 3\ min}$ | The traffic difference of the vehicle group before 2-3 min | 0.055 |
| $Vol_{diff,\ 4\ min}$ | The poor flow of the vehicle group before 3-4 min | 0.037 |
| $Vol_{truck,\ diff,\ 1\ min}$ | The truck traffic of the vehicle group before 0-1 min | 0.209 |
| $Speed_{aver,\ 1\ min}$ | The average speed of the vehicle group before 0-1 min | 0.063 |

In step 2) mentioned above, the ramp metering is the downstream ramp to pass within 1 min. The starting moment of the downstream ramp metering is the moment when the group reaches the ramp. The metering rate of the first downstream ramp is calculated by using the improved ALINEA algorithm and the ramp metering model based on the METANET model. The metering rate of the downstream multiple ramps is consistent with the metering rate of the first downstream ramp to pass through.

$$h_i'(k) = \min\left\{d_i(k) + \frac{w_i(k)}{T},\ Q_i(k),\ Q_i(k)\frac{\rho_{max,i} - \rho_i(k)}{\rho_{max,i} - \rho_{crit,i}},\ r_i(k)\right\}$$

$$r_i(k) = r_k(k-1) + K_R\left[\hat{O} - O_{out}(k-1)\right] + K_S\left[\sum_{j=1}^{n} \beta_{ij}(CI_{crit} - CI_{ij}(k-1))\right]$$

wherein $h_i'(k)$ is the integrated the ramp metering rate, $d_i(k)$ is the demand of the segment i in the k time period corresponding to the ramp, $w_i(k)$ is the queue length of the segment i in the k time period corresponding to the ramp, T is the control step which the value is 1 min, $Q_i(k)$ is the traffic capacity of the road, $\rho_{max,i}$ is the maximum density of the mainline, $\rho_i(k)$ i to the density of the mainline, $\rho_{crit,i}$ is the critical density of the mainline, $r_i(k)$ is the ramp regulation rate of ramp corresponding to segment i in the k time period, $r_i(k-1)$ is the ramp metering rate in the k−1 time period, $K_R$ is the mainline occupancy regulation parameter, $K_S$ is the safety factor regulation parameter, $\hat{O}$ is the desired occupancy rate, $O_{out}(k-1)$ is the mainline occupancy rate in the k−1 time period, is the weight of crash risk of vehicle group j, n is the upstream number of vehicle groups, $CI_{crit}$ is the threshold of crash risk index, and $CI_{ij}(k-1)$ is the crash risk index of the k−1 time period.

In step 3) mentioned above, the following steps in which the speed limits for the downstream segment of the vehicle group are obtained:

31) generating the combination of multiple speed limits corresponding to the road segments to be passed by the next time period of the vehicle group according to the current average speed of the vehicle group and the constraints;

32) calculating the corresponding crash risk index under each speed limit combination to select the optimal speed limit combination with the lowest crash risk index as the target function; and 33) getting adjusted setting segment speed limit value which is the speed limit display value according to the actual driver compliance rate of the previous control step of the reference vehicle group to adjust the optimal speed limit, and returning to step 1 after controlling the adjusted road speed limit within the control step.

In step 31) mentioned above, generating the combinations of the multiple speed limits corresponding to the road segments to be passed by the next time period of the vehicle group as follows:

The preliminary speed limit value combinations are obtained from the current speed of the vehicle group by adding or subtracting operations. And the combinations of the incompatible traffic efficiency constraint, the incompatible time variation constraint and the incompatible spatial variation constraint are eliminated from all the preliminary speed limit value combinations, and finally multiple combinations of setting speed limit values are obtained. The constraints are specified as follows:

Traffic Efficiency Constraints:

$$\frac{L_i}{v_i(k+1)} \le (1+t_m)\frac{L_i}{v_i'(k+1)}$$

Time Variation Constraints:

$$|V_{VSL,i}(k+1)-V_{VSL,i}(k)| \le spd_{diff,t}$$

Spatial Variation Constraints:

$$|V_{VSL,i+1}(k)-V_{VSL,i}(k)| \le spd_{diff,s}$$

wherein $L_i$ is the length of segment i, $v_i(k+1)$ is the average speed of segment i under speed limit, $v'_i(k+1)$ is the average speed of segment i under unlimited speed, $t_m$ is the increase rate of travel time, $V_{VSL,i}(k)$ is the set speed limit value of segment i in the k time period, $V_{VSL,i}(k+1)$ is the speed limit value of segment i in the k+1 time period, $spd_{diff,t}$ is the speed limit difference threshold for adjacent time periods in the same segment, $spd_{diff,s}$ is the speed limit difference threshold for adjacent control segments in the same time period.

In step 32) mentioned above, the target function expression is:

$$\min \Sigma_{j=1}^{n} a_{ij} \cdot CI_{ij}(k+1)$$

wherein $CI_{ij}(k+1)$ is the crash risk index of the $j^{th}$ vehicle group upstream of the segment i in the $(k+1)^{th}$ time period, $a_{ij}$ is the weight of the crash risk of the $j^{th}$ vehicle group upstream of the segment i, and n is the number of vehicle groups to be considered upstream of the segment i.

In step 33) mentioned above, the expression of the adjusted setting segment speed limit value is:

$$[V_{VSL,i}^{D}(k+1)]_5 = (1-\alpha_c)V_{VSL,i}(k+1)$$

$$\alpha_c = \frac{\sum_{i=1}^{n}(v_i(k) - V_{VSL,i}^{D}(k))}{\sum_{i=1}^{n} V_{VSL,i}^{D}(k)}$$

wherein $V_{VSL,i}^{D}(k+1)$ is the adjusted speed limit display value in the k+1 time period, [ ]5 means taking an integer multiple of 5, $\alpha_c$ is the driver compliance rate, $V_{VSL,i}(k+1)$ is the speed limit value set of the segment i in the k time period, $v_i(k)$ is the speed of the vehicle group of the segment i in the k time period, $V_{VSL,i}^{D}(k)$ is the speed limit display value in the k time period, and n is the number of speed limit segments passed by the vehicle group in the k time period.

In step 32) mentioned above, the integrated ramp metering rate, mainline desired speed, and mainline speed of the segment for the next period are adjusted according to the speed limit display values. The crash risk index is calculated by obtaining the value of variable $x_r$ based on the regulated mainline speed of the next segment.

(1) Expected Speed for the Mainline:

Taking the speed limit $V_{VSL,i}(k)$ obtained in step 31) for different combinations as the free flow speed $v_{free,i}^{VSL}(k)$ under variable speed limit control, to calculate the coefficient $b_{VSL}(k)$ of the effect of variable speed limit control on the free flow speed and adjust the mainline desired speed $V(\rho_i(k))$, wherein $$V'(\rho_i(k)) = v_{free,i}^{VSL}(k)\cdot\exp\left[-\frac{1}{o_m^{VSL}(k)}\left(\frac{\rho_i(k)}{\rho_{crit,i}^{VSL}(k)}\right)^{o_m^{VSL}(k)}\right]$$

$$v_{free,i}^{VSL}(k) = b_{VSL}(k)\cdot v_{free,i}(k)$$

$$o_m^{VSL}(k) = o_m[E_m - (E_m-1)b_{VSL}(k)]$$

$$\rho_{crit,i}^{VSL}(k) = \rho_{crit,i}(k)[1 + A_m(1-b_{VSL}(k))]$$

Wherein $V'(\rho_i(k))$ is the adjusted mainline desired speed, $v_{free,i}(k)$ is the free-flow speed under infinite speed control of segment i in the k+1 time period, $o_m$ is the parameter under infinite speed, $o_m^{VSL}(k)$ is the parameter under variable speed limit, $\rho_{crit,i}^{VSL}(k)$ is the mainline critical density under variable speed limit, $\rho_{crit,i}(k)$ is the mainline critical density under infinite speed condition, $E_m$ is the coefficient of effect of variable speed limit control on parameter $o_m$, and $A_m$ is the coefficient of effect of variable speed limit control on the mainline critical density $\rho_{crit,i}(k)$.

(2) For Ramp Metering Rate:

The adjusted integrated ramp metering rate is as follows:

$$h_i''(k) = \min\{h_i'(k), q_{cap} - q_i(k)\}$$

$$q_{cap} = \lambda_i V'(\rho_{crit}(k)) * \rho_{crit}(k)$$

Wherein $h_i''(k)$ is the adjusted integrated ramp metering rate, $q_{cap}$ is the mainline capacity under the variable speed limit, $q_i(k)$ is the volume of segment i in the k time period, $\lambda_i$ is the number of mainline lanes, $V'(\rho_{crit}(k))$ is the expected speed of the mainline at variable speed limit with critical density of $\rho_{crit}(k)$, $\rho_{crit}(k)$ is the mainline key density.

(3) For the Main Road Speed Next Period:

$$v_i(k+1) = v_i(k) + \frac{T}{\tau}\cdot\Delta v1 - \frac{T}{L_i}v_i(k)\cdot\Delta v2 - \frac{\eta T}{\tau L_i}\cdot\frac{\rho_{i+1}(k)-\rho_i(k)}{\rho_i(k)+\sigma} - \frac{\delta T h_i''(k) v_i(k)}{L_i\lambda_i(\rho_i(k)+\sigma)}$$

$$\Delta v1 = V'(\rho_i(k)) - v_i(k)$$

$$\Delta v2 = v_i(k) - v_{i-1}(k)$$

wherein $$\frac{\delta T h_i''(k) v_i(k)}{L_i\lambda_i(\rho_i(k)+\sigma)}$$

is the discount term for the mainline speed generated by the ramp metering rate, $v_i(k+1)$ is the mainline speed of the segment i in the k+1 time period, $v_i(k)$ and $v_{i-1}(k)$ are mainline speeds of the segment i and segment i−1 respectively in the k+1 time period. Δv1 and Δv2 are the intermediate parameters, r is the driver adjustment delay factor, T is the control step, η is the speed density sensitivity factor, $L_i$ is the corresponding mainline length of segment i, $\rho_i(k)$ and $\rho_{i+1}(k)$ are the mainline densities of segment i and segment i+1, respectively, and a is the compensation factor.

The method further includes:

4) After 1 control step of the cooperative control strategy, crash risk setting the transitional speed limit is set to avoid excessive changes in the speed of the vehicle group when the crash risk index is lower than the threshold of the crash risk index. The normal speed limit is retuned after two segments:

$$V_{VSL,i}^{D}(k+1)=[v_i(k)+10]_5$$

wherein $V_{VSL,i}^{D}(k+1)$ is the speed limit display value of downstream segment i in the k+1 time periods, $v_i(k)$ is the speed of downstream segment i in the k time periods, and $[\ ]_5$ represents that the speed limit value is an integral multiple of 5.

Compared with the existing technology, the present invention has the following advantages:

(1) Dynamic adjustment control strategy: The invention takes the vehicle group crash risk as the basis for the implementation of the control strategy, can be controlled according to the real-time and predicted traffic state of the vehicle group, thus avoiding the occurrence of crashes in advance, according to the crash risk of the vehicle group dynamically adjust the control strategy, variable speed limit and ramp metering duration and implementation distance will also be reduced.

(2) Improve vehicle group safety: introduce vehicle road coordination technology into the control strategy, and affect the surrounding vehicles, change the speed of vehicles on the road segment, improve the safety of the vehicle fleet, and in the vehicle road coordination environment, road facilities and vehicle communication, downstream ramps can know the arrival time of the vehicle group, interactive open ramp metering strategy, will provide ideas for traffic management and control in the future vehicle network environment.

(3) Multiple segments variable speed limit, multiple ramps coordination control: the use of multi-segment variable speed limit, multi-segment coordination control and the two co-control, and is based on multi-vehicle group crash risk. It can prevent the risk of vehicle crashes from rising again and improve the traffic safety of fast roads more effectively.

DETAILED DESCRIPTION OF THE EMBODIMENTS

The current variable speed limit and ramp metering method based on crash risk is more of a single point and a single strategy. The implementation of control strategies at a single point may shift the risk of crashes from upstream to downstream, and single-policy control may not be able to better exploit the benefits of the strategy. The adoption of variable speed limit and multi-lane coordination control of multi-segment segments can prevent the continuous reduction of the risk of crashes, prevent the transfer of high crash risk vehicle groups. Variable speed limit is to control the mainline traffic, ramp metering is for ramp traffic, the two synergistic control, may be better use of their technical advantages. In addition, most of the previous studies have been carried out in the environment without connected vehicles, variable speed limit and ramp metering mainly based on the possibility of crashes occurring on the road segment or after the occurrence of crashes to start control. The invention is in a vehicle-road cooperative situation, where variable speed limits and ramp control can be targeted at a vehicle group passing through the roadway, allowing real-time monitoring of the crash risk of the vehicle group as opposed to targeting the roadway crash risk. The control strategy is dynamically adjusted to the crash risk of the vehicle group, and the duration and implementation distance of variable speed limits and ramp controls are reduced.

The present invention is described in detail in the following combination with the drawings and the specific embodiments.

Figure 1:
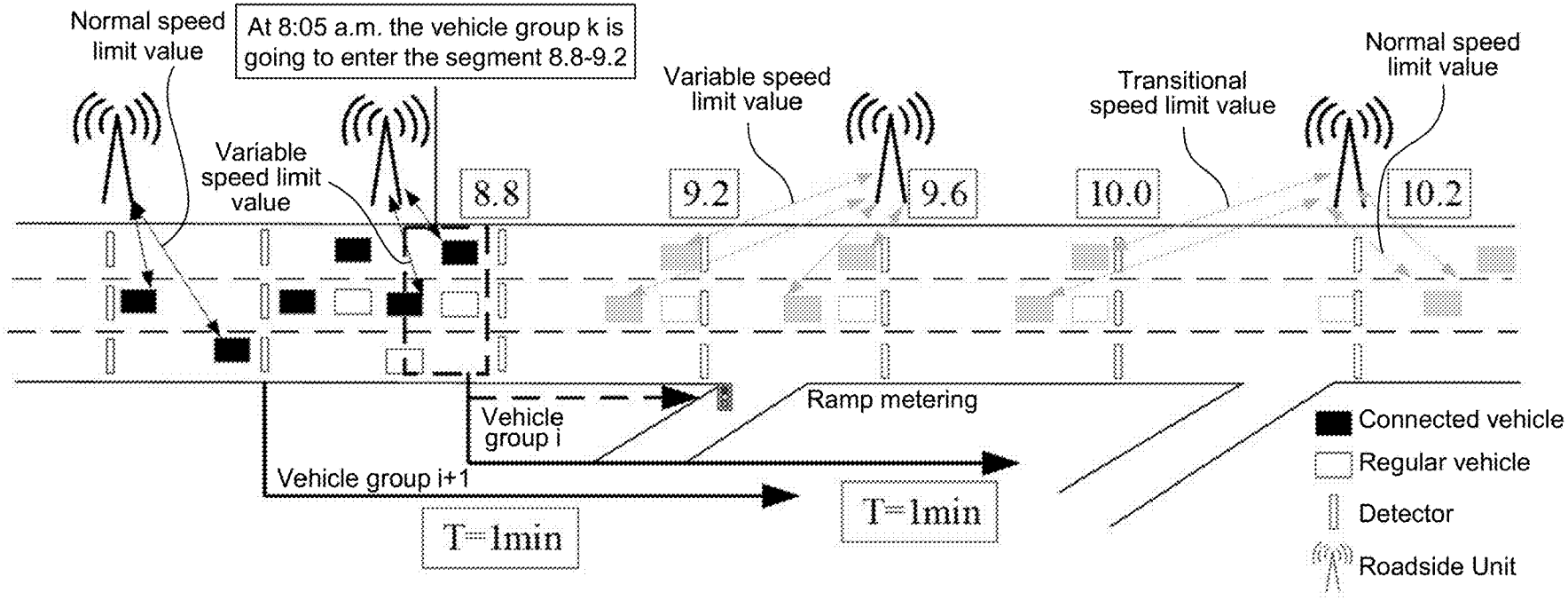
FIG. 1 shows the coordinated control diagram of variable speed limit and ramp metering.
Figure 4:
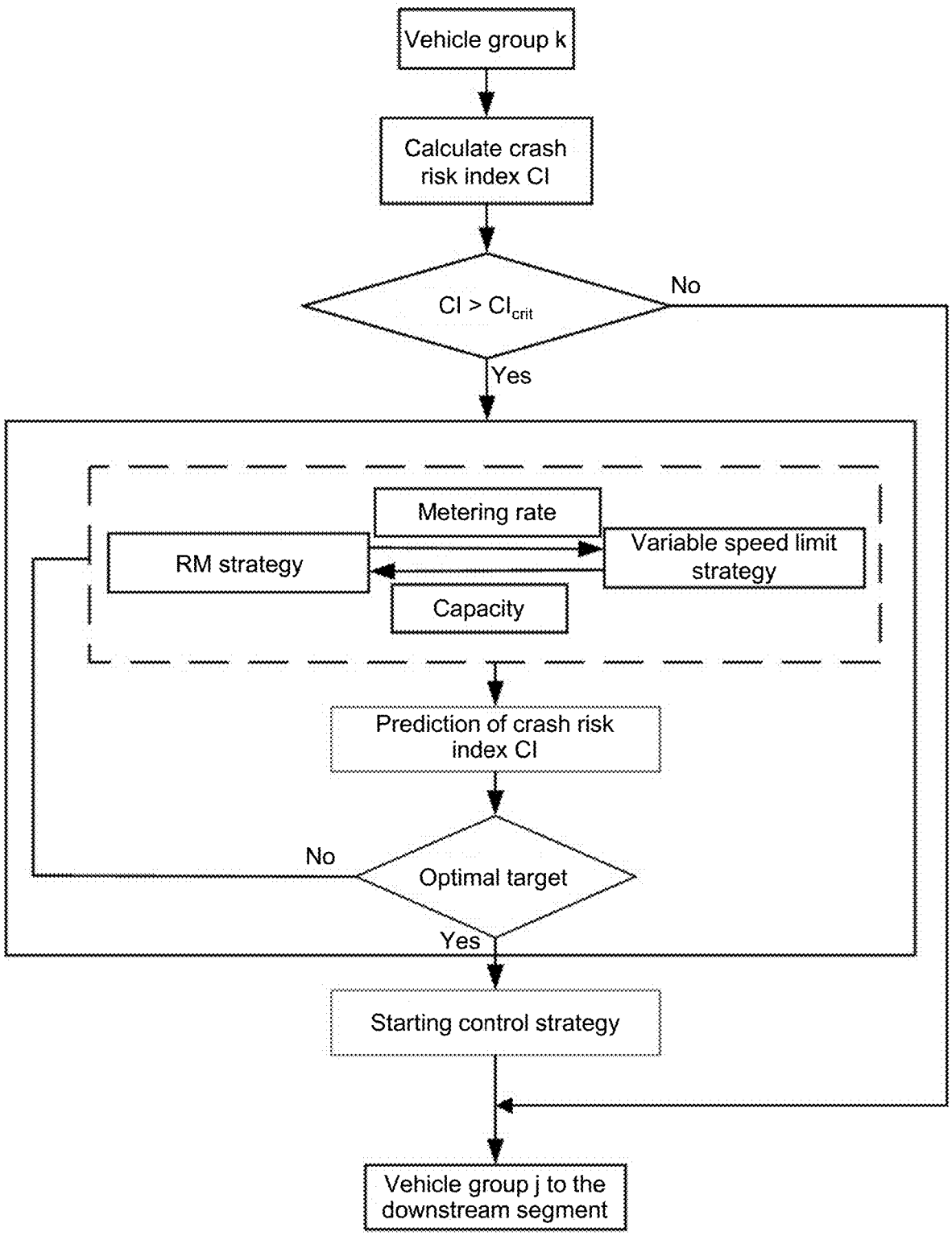
FIG. 4 is a flow chart of the coordinated variable speed limit and ramp metering.

As shown in FIGS. 1 and 4, the invention provides a collaborative controlling method of variable speed limit and ramp metering for expressways based on crash risk, and includes the following steps:

The invention, based on the crash risk of the vehicle group, realizes the variable speed limit, the multi-ramp metering, and the integrated variable speed limit and ramp metering. The control strategies are implemented based on the real-time and predicted traffic status of the vehicle fleet, thus avoiding accidents in advance, in the following steps:

(1) First, the crash risk of the vehicle group is calculated in real time, and the crash risk index is calculated by tracing the traffic flow and speed of the vehicle group before 0-4 min to characterize the crash risk of the vehicle group. When the crash risk index of the vehicle fleet is above the threshold, the control strategy is activated $$CI=\Sigma_{r=1}^{R}\beta_r x_r \tag{1}$$

wherein:

CI: Crash Risk Index;

$\beta_r$: The coefficient of the $r_{th}$ variable;

$x_r$: The value of the $r_{th}$ variable;

R: The total number of variables.

TABLE 1 calculates the variables of the crash risk index

| Variable $x_r$ | Meaning | Variable coefficient $\beta_r$ |
|---|---|---|
| $Speed_{diff,\ 1\ min}$ | The speed difference of the vehicle group before 0-1 min | 0.292 |
| $Speed_{diff,\ 2\ min}$ | The speed difference of the vehicle group before the 1-2 min | 0.125 |
| $Speed_{diff,\ 3\ min}$ | The speed difference of the vehicle group before the 2-3 min | 0.191 |
| $Speed_{diff,\ 4\ min}$ | The speed difference of the vehicle group before the 3-4 min | 0.107 |
| $Vol_{diff,\ 1\ min}$ | The traffic difference of the vehicle group before the 0-1 min | 0.105 |
| $Vol_{diff,\ 2\ min}$ | The traffic difference of the vehicle group before 1-2 min | 0.054 |
| $Vol_{diff,\ 3\ min}$ | The traffic difference of the vehicle group before the 2-3 min | 0.055 |
| $Vol_{diff,\ 4\ min}$ | The traffic difference of the vehicle group before 3-4 min | 0.037 |
| $Vol_{truck,\ diff,\ 1\ min}$ | The truck traffic of the vehicle group before 0-1 min | 0.209 |
| $Speed_{aver,\ 1\ min}$ | The average speed of the vehicle group before 0-1 min | 0.063 |

Figure 2:
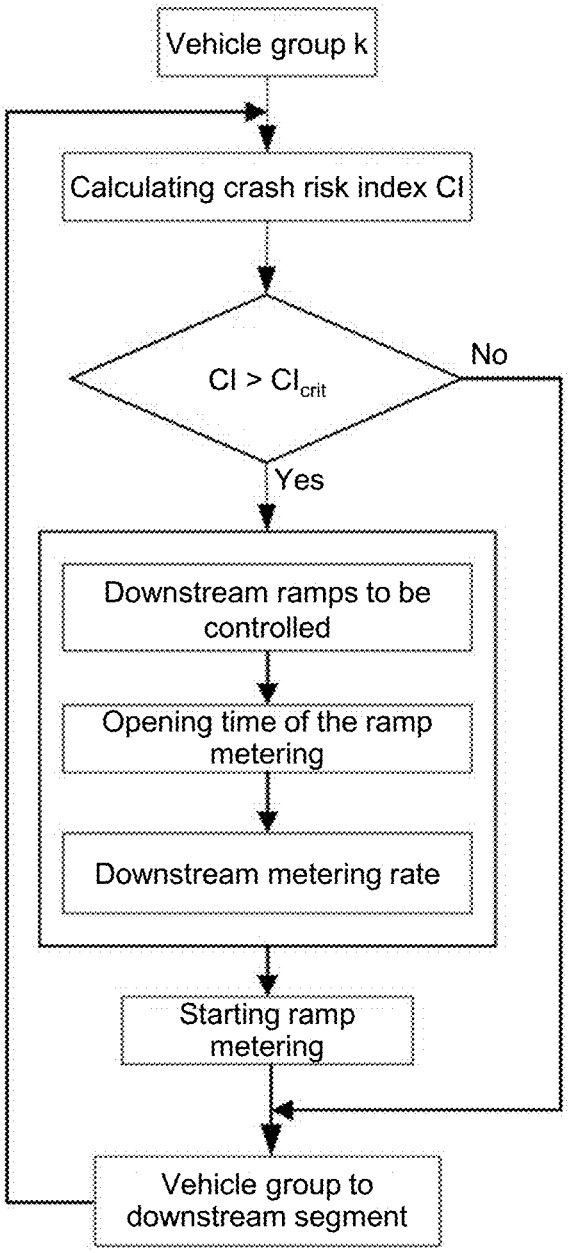
FIG. 2 is a flow chart of multi-ramp coordination strategies.

(2) Then the multiple ramp control strategy is introduced, as shown in FIG. 2, to determine the ramps to be controlled, the ramp regulation rate and the calculation of the onset moment of ramp control. The control ramp is the downstream ramp to be passed by the vehicle group for 1 min, and the onset moment of downstream ramp control is the moment when the vehicle group arrives at the ramp. The improved ALINEA algorithm is fused with the ramp convergence model of the METANET model to calculate the regulation rate of the first downstream ramp. The regulation rate of multiple downstream ramps is the same as the regulation rate of the first downstream ramp to be passed, and then the ramp regulation rate is input to the cooperative control in step (4).

Downstream ramp metering start-up time calculation:

$$t_i = \frac{LR_i}{v_i} \tag{2}$$

AILINEA algorithm that considers improved crash risk for multiple upstream fleets:

$$r_i(k)=r_i(k-1)+K_R[\hat{O}-O_{out}(k-1)]K_S[\Sigma_{j=1}^{n}\beta_{ij}(CI_{crit}-CI_{ij}(k-1))] \tag{3}$$

The ramp of the MEATANET model sinks into the model:

$$h_i(k) = \min\left\{d_i(k) + \frac{w_i(k)}{T},\ Q_i(k),\ Q_i(k)\frac{\rho_{max,i}-\rho_i(k)}{\rho_{max,i}-\rho_{crit,i}}\right\} \tag{4}$$

The metering rate of the first ramp downstream is calculated:

$$h_i'(k) = \min\left\{d_i(k) + \frac{w_i(k)}{T},\ Q_i(k),\ Q_i(k)\frac{\rho_{max,i}-\rho_i(k)}{\rho_{max,i}-\rho_{crit,i}},\ r_i(k)\right\} \tag{5}$$

TABLE 2 ramp metering model parameters

| variable | meaning | variable | meaning |
|---|---|---|---|
| $t_i$ | The time which the vehicle group arrives to the segment i corresponding to the ramp | $d_i(k)$ | The demand of the segment i corresponds to the ramp in the k time period |
| $LR_i$ | The distance of the vehicle group from the segment i corresponding to the ramp | $w_i(k)$ | The queue length of the segment i corresponds to the ramp in the k time period |
| $v_i$ | The average speed of the vehicle group from the section i corresponds to the ramp | T | Forecast period (1 min) |
| $h'_i(k)$ | The metering rate of the integrated ramp | $Q_i(k)$ | The ability to pass the ramp |
| $K_R$ | The mainline occupancy adjustment parameters | $\rho_{max,\ i}$ | Maximum density of the mainline |
| $\hat{O}$ | Expected possession | $\rho_i(k)$ | Mainline density |
| n | Number of upstream vehicle group | $\rho_{crit,\ i}$ | The critical density of the mainline |
| $K_S$ | Safety factor adjustment parameters | $O_{out}(k-1)$ | Mainline occupancy |
| $\beta_{ij}$ | Weight of vehicle group crash risk | $CI_{ij}(k-1)$ | Crash risk index |
| $CI_{crit}$ | The threshold for the crash risk index | $r_i(k-1)$ | Ramp metering rate in the k − 1 time period |

Figure 3:
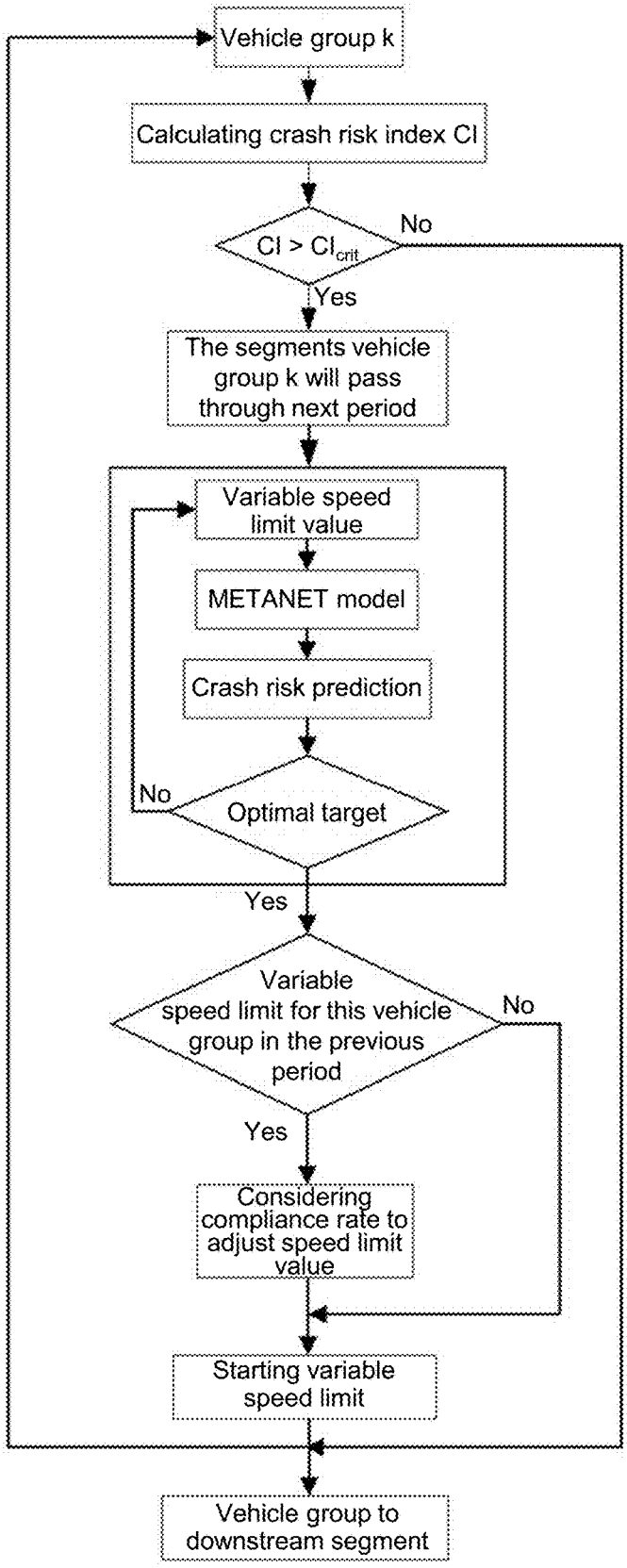
FIG. 3 is a flow chart of variable speed limit policies for multiple segments.

(3) Next is the variable speed limit strategy, as shown in FIG. 3, which calculates the speed limit value of the downstream segment of the vehicle group. The speed limit value of the road segment to be passed by the group for 1 step (1 min) is set by subtracting or adding 5 km/h, 10 km/h and 15 km/h from the current speed of the group. The speed limit values are taken as integer multiples of 5 to obtain the initial combination of speed limit values for the downstream segment. Considering the constraints of traffic efficiency, time variation and space variation of the speed limit values, the combinations that do not meet the constraints are eliminated and multiple combinations of setting speed limit values are obtained. The different combinations of set speed limit values are input to the cooperative control strategy in step (4).

Traffic efficiency constraints: Avoid the adoption of low speed limits resulting in low traffic efficiency, variable speed limits and invariable speed limits compared to the trip time, the increase in travel time does not exceed $t_m$ (value 0.05).

$$\frac{L_i}{v_i(k+1)} \le (1+t_m)\frac{L_i}{v_i'(k+1)} \tag{6}$$

Time change constraints: Taking into account driver safety and comfort, the speed limit for adjacent time periods in the same segment of the road cannot change too much, not more than km/h (takes$pd_{diff,t}$10 km/h), for road segment i there is $$|V_{VSL,i}(k+1)-V_{VSL,i}(k)|\le spd_{diff,t} \tag{7}$$

Spatial change constraints: The speed limit difference of adjacent control segments in the same time period should not be too large, not exceeding km/h (take 20 km/h), then yesspd$_{diff,s}$ $$|V_{VSL,i+1}(k)-V_{VSL,i}(k)|\leq spd_{diff,s} \tag{8}$$

Variable speed limits do not increase the average travel time by too much compared to invariable speed limits (traffic efficiency constraints), the maximum limit difference between the two adjacent segments in the same time period is 20 km/h (space constraint), and the maximum difference between two consecutive control time step speed limits for the same segment is 10 km/h (time constraint);

TABLE 3

Variable speed limit model parameters

| variable | meaning | variable | meaning |
|---|---|---|---|
| $v_i(k+1)$ | The speed of the segment i under speed limit | $spd_{diff,t}$ | The maximum speed limit difference for adjacent time periods of the same segment |
| $v'_i(k+1)$ | The speed of the segment i under unlimited speed | $spd_{diff,s}$ | The maximum speed limit difference for adjacent segments in same time period |
| $V_{VSL,i+1}(k)$ | The speed limit value set for segment i + 1 in k time period | $V_{VSL,i}(k+1)$ | The speed limit value for segment i in k + 1 time period |
| $V_{VSL,i}(k)$ | The speed limit value for segment i in k time period | $L_i$ | The length of the segment i |
| $t_m$ | The increase rate in travel time | | |

(4) Then there is Collaborative Controlling.

First of all, consider the influence of variable speed limit on the expected speed of the mainline, the set speed limit value $V_{VSL,i}(k)$, under different segment i in the k time periods as the free flow speed $v_{free,i}^{VSL}(k)$ under variable speed control, calculate the influence coefficient $b_{VSL}(k)$ of variable speed limit control on free flow speed, and adjust the expected speed $V(\rho_i(k))$ of the mainline accordingly, there are:

$$V'(\rho_i(k)) = v_{free,i}^{VSL}(k)\cdot\exp\left[-\frac{1}{o_m^{VSL}(k)}\left(\frac{\rho_i(k)}{\rho_{crit,i}^{VSL}(k)}\right)^{o_m^{VSL}(k)}\right]$$

$$v_{free,i}^{VSL}(k) = b_{VSL}(k)\cdot v_{free,i}(k)$$

$$o_m^{VSL}(k) = o_m[E_m-(E_m-1)b_{VSL}(k)]$$

$$\rho_{crit,i}^{VSL}(k) = \rho_{crit,i}(k)[1+A_m(1-b_{VSL}(k))]$$

wherein $V'(\rho_i(k))$ is the adjusted mainline desired velocity, $v_{free,i}(k)$ is the free-flow velocity under infinite speed limit for segment i in the k time period, $o_m$ is the parameter under infinite speed, $o_m^{VSL}(k)$ is the parameter under variable velocity limit, $\rho_{crit,i}^{VSL}(k)$ is the mainline critical density under variable velocity limit, $\rho_{crit,i}(k)$ is the mainline critical density under infinite speed condition, $E_m$ is the coefficient of the effect of variable speed limit control on parameter $o_m$, and $A_m$ is the coefficient of the effect of variable speed limit control on the mainline critical density.

The ramp metering rate adjusted according to the desired speed of the mainline at a variable speed limit. When the variable speed limit value changes, it affects the capacity of the mainline, which in turn affects the metering rate, and the adjusted metering rate IV (k) is:

$$h_i''(k)=\min\{h_i'(k),q_{cap}-q_i(k)\}$$

$$q_{cap}=\lambda_i V'(\rho_{crit}(k))*\rho_{crit}(k)$$

wherein $q_{cap}$ is mainline capacity at variable speed limit, veh/h, $q_i(k)$ is flow rate of segment i in the k time period, veh/h, $V'(\rho_{crit}(k))$ is desired speed of mainline at critical density at variable speed limit, km/h, $\rho_{crit}(k)$ is critical density of mainline, veh/km/lane. takes the value of 33.3 veh/km/lane.

The calculation of the discount term of the ramp flow to the mainline speed. The flow of the ramp into the mainline decreases, and the discount of the ramp to the mainline speed decreases. The discount of the traffic flow to the mainline speed for the next period is:

$$-\frac{\delta Th_i''(k)v_i(k)}{L_i\lambda_i(\rho_i(k)+\sigma)}$$

wherein δ is ramp convergence influence coefficient, taken as 0.0122, $h_i''(k)$ is ramp metering rate corresponding to segment i in the k time period, $v_i(k)$ is mainline speed in the k time period, $\lambda_i$ is mainline lane number, number of lanes, and $\rho_i(k)$ is mainline density in the k time period.

Further, the flow, density and speed parameters of the next period of the road segment are calculated using the METANET macro traffic flow model.

For segment i, the density $\rho_i(k+1)$ of the next period:

$$\rho_i(k+1) = \rho_i(k) + \frac{T}{L_i\lambda_i}[q_{i-1}(k) - q_i(k) + h_i''(k) - s_i(k)]$$

For segment i, the speed $v_i(k+1)$ of the next period:

$$v_i(k+1) = v_i(k) + \frac{T}{\tau}\cdot\Delta v1 - \frac{T}{L_i}v_i(k)\cdot\Delta v2 - \frac{\eta T}{\tau L_i}\cdot\frac{\rho_{i+1}(k)-\rho_i(k)}{\rho_i(k)+\sigma} - \frac{\delta Th_i''(k)v_i(k)}{L_i\lambda_i(\rho_i(k)+\sigma)}$$

$$\Delta v1 = V'(\rho_i(k)) - v_i(k)$$

$$\Delta v2 = v_i(k) - v_{i-1}(k)$$

For segment i, traffic $q_i(k+1)$ for the next period:

$$q_i(k+1)=\rho_i(k+1)\cdot v_i\cdot(k+1)-\lambda_i$$

wherein $s_i(k)$ is the exit ramp flow corresponding to segment i. If not available, the taken value is 0. $v_i(k)$ and $v_{i-1}(k)$ are the mainline speeds of segment i and segment i−1, respectively, in the k time period. Δv1 and Δv2 are intermediate parameters, τ is the driver adjustment delay factor, T is the control step, η is the speed density sensitivity factor, $L_i$ is the mainline length corresponding to segment i, $\rho_i(k)$, $\rho_{i+1}(k)$ are the mainline densities of segment i and segment i+1, respectively, and a is the compensation coefficient.

The crash risk prediction variables $x_r$ in Table 1 are obtained based on the flow, density and speed parameters of the roadway segment in the next time period, and then the crash risk of the traffic group is predicted for different combinations of ramp regulation rate and speed limit settings.

Further, when the predicted crash risk for the next segment is minimal, the speed limit and ramp regulation rate of the road segment to be passed in the next segment are obtained.

Objective function: The risk of multiple vehicle crashes is minimal in the next period.

$$\min \Sigma_{j=1}^{n} a_{ij} \cdot CI_{ij}(k+1) \tag{14}$$

wherein $CI_{ij}(k+1)$ is the crash risk index of the $j^{th}$ vehicle group upstream of the segment i in the $(k+1)^{th}$ time period; $a_{ij}$ is the weight of the crash risk of the jth vehicle group upstream of the segment i; n is the number of vehicle groups to be considered upstream of segment i.

The optimal combination of speed limit values is adjusted. Considering the actual compliance rate of the drivers of this group in the previous 1 min, the displayed value of the speed limit value of the road to be passed by this group in the next period is adjusted. When the average speed of the group in the previous period is greater than the variable speed limit, the display value of the speed limit of the group in the next period is lowered, and vice versa, and the display value is an integer multiple of 5.

$$[V_{VSL,i}^{D}(k+1)]_5 = (1-\alpha_c)V_{VSL,i}(k+1)$$

$$\alpha_c = \frac{\sum_{i=1}^{n}(v_i(k) - V_{VSL,i}^{D}(k))}{\sum_{i=1}^{n} V_{VSL,i}^{D}(k)}$$

wherein $V_{VSL,i}^{D}(k+1)$ is the speed limit display value of downstream segment i in the k+1 time periods, $v_1$ (k) is the speed of downstream segment i in the k time periods, and $[\ ]_5$ represents that the speed limit value is an integral multiple of 5.

Further, the speed limit display value is published to the network-connected vehicle and the ramp metering rate is transmitted to the controller of the downstream ramp.

(5) After the control strategy has been implemented for 1 step (1 min), calculate the crash risk index of the vehicle group, if above the threshold, return to step 1 and continue to implement the control. If below the threshold, set the transition speed limit, after two segments to return to normal speed limit.

$$VSL_i(k+1)=[v_i(k)+10]5 \tag{15}$$

wherein $VSL_i(k+1)$: the speed limit value of the downstream segment in the k+1 time period; $v_i(k)+10$: the speed of the downstream segment in the k time period; [ ]5 represents that the speed limit value is an integral multiple of 5

Example

In this example, take vehicle group j as an example, including the following steps:

1. Each step (1 min) traces the trajectory of the vehicle group j before entering a segment 0-4 min, calculating the crash risk of vehicle group j by traffic parameters such as traffic difference and speed difference of detector data along the track.

2. At 8:05 the vehicle group j is going to enter the mile marker segment 8.8-9.2. The crash risk index calculated from step 1 is higher than the threshold value and is transferred to step 3. Calculate the downstream ramp regulation rate, the opening moment of ramp control, and the speed limit value, and do not control if it is lower than the threshold value.

3. The coordinated control strategy for multiple ramps includes determining the ramps to be controlled, the ramp regulation rate and the opening moment of the ramp control. The control ramp is the downstream ramp that the group of vehicles will pass through in 1 min. The start moment of the downstream ramp control is the moment when the vehicle group arrives at the ramp. The improved ALINEA algorithm is fused with the ramp convergence model of the METANET model to calculate the regulation rate of the first downstream ramp. The regulation rate of multiple downstream ramps is the same as the regulation rate of the first downstream ramp to be passed, and then the ramp regulation rate is input to the cooperative control strategy in step 5.

4. Variable speed limit strategy, calculate the speed limit value of the downstream segment of the vehicle group. The speed limit value of the road segment to be passed by the group for 1 step (1 min) is set by subtracting or adding 5 km/h, 10 km/h, 15 km/h from the current speed of the group, and the speed limit value is taken as an integer multiple of 5. Consider the traffic efficiency constraint, time variation, space variation and other constraints of the speed limit values, and input the combination of different speed limit values to the 5th step of the cooperative control strategy.

5. Considering the interaction between ramp traffic and mainline traffic, the METANET macro traffic flow model is used to predict the risk of cluster accidents under different ramp regulation rates and speed limit values. Further, when the predicted crash risk for the next time period is minimal, the speed limit and ramp regulation rate of the road segment to be passed in the next time period are obtained.

6. After 1 step (1 min) of control policy implementation, calculate the crash risk index of vehicle group j. If it is higher than the threshold, return to step 1, consider the driver compliance rate of vehicle group j for the first 1 minute, and continue to implement control. If it is lower than the threshold, set the transitional speed limit and return the normal speed limit after two road segments.

What is claimed is:

1. A collaborative controlling method of variable speed limit and ramp metering for expressways based on crash risk, characterized by the following steps:

1) calculating the crash risk index CI within each control step and activate the collaborative controlling method of variable speed limit and ramp metering when the crash risk index exceeds the threshold of the crash risk index;

2) executing a multiple-ramp metering strategy, determine the ramps to be controlled and the start-up time for the ramp metering, and calculate an integrated ramp regulation rate $h_i'(k)$; and 3) executing a variable speed limit strategy to obtain the displayed speed limit value for a segment downstream of the cluster and adjust a ramp regulation rate, mainline desired speed and mainline speed of the segment for the next time period accordingly, wherein the goal is to minimize the crash risk of a vehicle group in the following period, and an optimal combination of speed limit and ramp metering rate of the segments to be passed in the next period are obtained.

2. The collaborative controlling method of variable speed limit and ramp metering for expressways based on crash risk according to claim 1, characterized in that, in step 1), the crash risk index CI within each control step is calculated on the basis of the METANET traffic flow and its expression is:

$$CI=\Sigma_{r=1}^{R}\beta_r x_r$$

wherein $\beta_r$, is the coefficient of the $r^{th}$ variable, $x_r$ is the $r^{th}$ variable, and R is the total number of variables.

3. The collaborative controlling method of variable speed limit and ramp metering for expressways based on crash risk according to claim 2, characterized in that, when the variable $x_r$ has meaning of speed difference of the vehicle group before 0-1 min, the variable coefficient $\beta_r$ is 0.292; when the variable $x_r$ meaning of speed difference of the vehicle group before 1-2 min, the variable coefficient $\beta_r$, is 0.125; when the variable $x_r$ meaning of speed difference of the vehicle group before 2-3 min, the variable coefficient $\beta_r$ is 0.191; when the variable $x_r$ has meaning of speed difference of the vehicle group before 3-4 min, the variable coefficient $\beta_r$ is 0.107; when the variable $x_r$ has meaning of traffic difference of the vehicle group before 0-1 min, the variable coefficient $\beta_r$, is 0.105; when the variable $x_r$ has meaning of traffic difference of the vehicle group before 1-2 min, the variable coefficient $\beta_r$ is 0.054; when the variable $x_r$ has meaning of traffic difference of the vehicle group before 2-3 min, the variable coefficient $\beta_r$, is 0.055; when the variable $x_r$ has meaning of traffic difference of the vehicle group before 3-4 min, the variable coefficient $\beta_r$, is 0.037; when the variable $x_r$ has meaning of poor truck traffic of the vehicle group before 0-1 min, the variable coefficient $\beta_r$ is 0.209; and when the variable $x_r$ has meaning of average speed of the vehicle group before 0-1 min, the variable coefficient $\beta_r$ is 0.063.

4. The collaborative controlling method of variable speed limit and ramp metering for expressways based on crash risk according to claim 1, characterized in that, in step 2), the ramp metering is the downstream ramp to pass within 1 min, the starting moment of the downstream ramp metering is the moment when the group reaches the ramp, the metering rate of a first downstream ramp is calculated by using an improved ALINEA algorithm and a ramp metering model based on the METANET model, and the metering rate of the downstream multiple ramps is consistent with the metering rate of the first downstream ramp to pass through, wherein $$h_i'(k) = \min\left\{d_i(k) + \frac{w_i(k)}{T},\ Q_i(k),\ Q_i(k)\frac{\rho_{max,i} - \rho_i(k)}{\rho_{max,i} - \rho_{crit,i}},\ r_i(k)\right\}$$

$$r_i(k) = r_i(k-1) + K_R\left[\hat{O} - O_{out}(k-1)\right] + K_S\left[\sum_{j=1}^{n} \beta_{ij}(CI_{crit} - CI_{ij}(k-1))\right]$$

wherein $h_i'(k)$ is the integrated the ramp metering rate, $d_i(k)$ is demand of the segment i in the time period k corresponding to the ramp, $w_i$ (k) is queue length of the segment i in time period k corresponding to the ramp, T is the control step, the value is 1 min, $Q_i(k)$ is the traffic capacity of the road, $p_{max,i}$ is the maximum density of the mainline, $\rho_i(k)$ is the mainline density-mainline, $\rho_{crit,i}$ is the mainline critical densitymainline, $r_i(k)$ is the ramp regulation rate of ramp corresponding to segment i in time period k, $r_i(k-1)$ is the ramp metering rate in time period k−1, $K_R$ is the mainline occupancy regulation parameter, $K_s$ is the safety factor regulation parameter, $\hat{O}$ is the desired occupancy rate, $O_{out}(k-1)$ is the mainline occupancy rate in time period k−1, $\beta_{ij}$ is the weight of crash risk of vehicle group j, n is the upstream number of vehicle groups, $CI_{crit}$ is the threshold of crash risk index, and $CI_{ij}(k-1)$ is the crash risk index of k−1 time period.

5. The collaborative controlling method of variable speed limit and ramp metering for expressways based on crash risk according to claim 1, characterized in that, in step 3), the following steps in which the speed limits for the downstream segment of the vehicle group are obtained:

31) generating combination of a plurality of speed limits corresponding to the road segments to be passed by the next time period of the vehicle group according to the current average speed of the vehicle group and the constraints;

32) calculating corresponding crash risk index under each speed limit combination to select the optimal speed limit combination with the lowest crash risk index as the target function; and 33) getting adjusted setting segment speed limit value which is the speed limit display value according to an actual driver compliance rate of the previous control step of a reference vehicle group to adjust the optimal speed limit, and returning to step 1 after controlling an adjusted road speed limit within the control step.

6. The collaborative controlling method of variable speed limit and ramp metering for expressways based on crash risk according to claim 5, characterized in that, in step 31) generating the combination of the plurality of speed limits corresponding to the road segments to be passed by the next time period of the vehicle group as follows:

obtaining preliminary speed limit value combinations from the current speed of the vehicle group by adding or subtracting operations, eliminating the combinations of incompatible traffic efficiency constraint, incompatible time variation constraint and incompatible spatial variation constraint from all the preliminary speed limit value combinations, and finally obtaining combinations of a plurality of setting speed limit values are obtained, wherein the constraints are comprise:

traffic efficiency constraints:

$$\frac{L_i}{v_i(k+1)} \le (1 + t_m)\frac{L_i}{v_i'(k+1)}$$

time variation constraints:

$$|V_{VSL,i}(k+1) - V_{VSL,i}(k)| \le spd_{diff,t}$$

spatial variation constraints:

$$|V_{VSL,i+1}(k) - V_{VSL,i}(k)| \le spd_{diff,s}$$

wherein $L_i$ is the length of segment i, $v_i(k+1)$ is the average speed of segment i under speed limit, $v'_i(k+1)$ is the average speed of segment i under unlimited speed, $t_m$, is the increase rate of travel time, $V_{VSL,i}(k)$ is the set speed limit value of segment i in the k time period, $V_{VSL,i}(k+1)$ is the speed limit value of segment i in the k+1 time period, $spd_{diff,t}$ is the speed limit difference threshold for adjacent time periods of the same segment, $spd_{diff,s}$ is the speed limit difference threshold for adjacent control segments in the same time period.

7. The collaborative controlling method of variable speed limit and ramp metering for expressways based on crash risk according to claim 5, characterized in that, in step 32), expressing the target function:

$$\min \sum_{j=1}^{n} a_{ij} \cdot CI_{ij}(k+1)$$

wherein $CI_{ij}(k+1)$ is the crash risk index of the $j^{th}$ vehicle group upstream of the segment i in the $(k+1)^{th}$ time period, $a_{ij}$ is the weight of the crash risk of the $j^{th}$ vehicle group upstream of the segment i, and n is the number of vehicle groups to be considered upstream of the segment i.

8. The collaborative controlling method of variable speed limit and ramp metering for expressways based on crash risk according to claim 5, characterized in that, in step 33), expressing the adjusted setting segment speed limit value:

$$[V_{VSL,i}^{D}(k+1)]_5 = (1-\alpha_c)V_{VSL,i}(k+1)$$

$$\alpha_c = \frac{\sum_{i=1}^{n}(v_i(k) - V_{VSL,i}^{D}(k))}{\sum_{i=1}^{n} V_{VSL,i}^{D}(k)}$$

wherein $V_{VSL,i}^{D}(k+1)$ is the adjusted speed limit display value in the k+1 time period, a number of 5 in $[V_{VSL,i}^{D}(k+1)]_5$ means taking an integer multiple of 5, $a_c$ is the driver compliance rate, $V_{VSL,i}(k+1)$ is the speed limit value set of the segment i in time period k segment i, $v_i(k)$ is the speed of the vehicle group of the segment i in time period k, $V_{VSL,i}^{D}(k)$ is the speed limit display value of the segment i in time period k segment i, and n is the number of speed limit segments passed by the vehicle group in time period k.

9. The collaborative controlling method of variable speed limit and ramp metering for expressways based on crash risk according to claim 8, characterized in that, in step 32), adjusting the integrated ramp metering rate, mainline desired speed, and mainline speed of the segment for the next period according to the speed limit display values, and obtaining the value of variable $x_r$ based on the regulated mainline speed of the next segment to calculate the crash risk index, wherein (1) expected speed for the mainline:

taking the speed limit $V_{VSL,i}(k)$ obtained in step 31) for different combinations as free flow speed $v_{free,i}^{VSL}(k)$ under variable speed limit control to calculate the coefficient $b_{VsL}(k)$ of the effect of variable speed limit, control on the free flow speed, and adjust the mainline desired speed $V(\rho_i(k))$, wherein $$V'(\rho_i(k)) = v_{free,i}^{VSL}(k)\cdot\exp\left[-\frac{1}{o_m^{VSL}(k)}\left(\frac{\rho_i(k)}{\rho_{crit,i}^{VSL}(k)}\right)^{o_m^{VSL}(k)}\right]$$

$$v_{free,i}^{VSL}(k) = b_{VSL}(k)\cdot v_{free,i}(k)$$

$$o_m^{VSL}(k) = o_m[E_m - (E_m-1)b_{VSL}(k)]$$

$$\rho_{crit,i}^{VSL}(k) = \rho_{crit,i}(k)[1 + A_m(1-b_{VSL}(k))]$$

$V'(\rho_i(k))$ is the adjusted mainline desired speed, $v_{free,i}(k)$ is the free flow speed under infinite speed control of segment i in the k+1 time period, $o_m$ is the parameter under infinite speed, $o_m^{vsL}(k)$ is the parameter under variable speed limit, $\rho_{crit,i}^{VSL}(k)$ is the mainline critical density under variable speed limit, $\rho_{crit,i}(k)$ is the mainline critical density under infinite speed condition, $E_m$ is the coefficient of effect of variable speed limit control on parameter $o_m$, and $A_m$ is the coefficient of effect of variable speed limit control on the mainline critical density $\rho_{crit,i}(k)$;

(2) ramp metering rate:

the adjusted integrated ramp metering rate is as follows:

$$h_i''(k)=\min\{h_i'(k), q_{cap}-q_i(k)\}$$

$$q_{cap}=\lambda_i V'(\rho_{crit}(k))*\rho_{crit}(k)$$

wherein $h_i''(k)$ is the adjusted integrated ramp metering rate, $q_{cap}$ is the mainline capacity under the variable speed limit, $q_i(k)$ is the volume of segment i in the k time period, $\lambda_i$ is the number of mainline lanes, $V'(\rho_{crit}(k))$ is the expected speed of the mainline at variable speed limit with critical density of $\rho_{crit}(k)$, and $\rho_{crit}(k)$ is the mainline key density; and (3) the main road speed next period:

$$v_i(k+1) = v_i(k) + \frac{T}{\tau}\cdot\Delta v1 - \frac{T}{L_i}v_i(k)\cdot\Delta v2 - \frac{\eta T}{\tau L_i}\cdot\frac{\rho_{i+1}(k)-\rho_i(k)}{\rho_i(k)+\sigma} - \frac{\delta T h_i''(k)v_i(k)}{L_i\lambda_i(\rho_i(k)+\sigma)}$$

$$\Delta v1 = V'(\rho_i(k)) - v_i(k)$$

$$\Delta v2 = v_i(k) - v_{i-1}(k)$$

where $$\frac{\delta T h_i''(k)v_i(k)}{L_i\lambda_i(\rho_i(k)+\sigma)}$$

is the discount term for the mainline speed generated by the ramp metering rate, $v_i(k+1)$ is mainline speed of segment i in the k+1 time period, $v_i(k)$ and $v_{i-1}(k)$ are the mainline speeds of segment i and segment i-I respectively in the k+1 time period, $\Delta v1$ and $\Delta v2$ are intermediate parameters, $\tau$ is driver adjustment delay factor, T is control step, $\eta$ is speed density sensitivity factor, $L_i$ is corresponding mainline length of segment i, $\rho_1(k)$ and $\rho_{i+i}(k)$ are the mainline densities of segment i and segment i+1 respectively, and $\sigma$ is the compensation factor.

10. The collaborative controlling method of variable speed limit and ramp metering for expressways based on crash risk according to claim 1, characterized in that, the collaborative controlling method further comprising:

4) after 1 control step of the cooperative control strategy, crash risk setting the transitional speed limit to avoid excessive changes in the speed of the vehicle group when the crash risk index is lower than the threshold of the crash risk index, and return the normal speed limit after two segments:

$$V_{VSL,i}^{D}(k+1)=[v_i(k)+10]_5$$

wherein $V_{VSL,i}^{D}(k+1)$ is the speed limit display value of downstream segment i in the k+1 time periods, $v_i(k)$ is the speed of downstream segment i in the k time periods, and a number of 5 in $[v_i(k)+10]_5$ represents that the speed limit value is an integral multiple of 5.

* * * * *